US010781979B2

(12) United States Patent
Jiang et al.

(10) Patent No.: US 10,781,979 B2
(45) Date of Patent: Sep. 22, 2020

(54) LED BULB LAMP

(71) Applicant: JIAXING SUPER LIGHTING ELECTRIC APPLIANCE CO., LTD., Jiaxing, Zhejiang (CN)

(72) Inventors: Tao Jiang, Zhejiang (CN); Liqin Li, Zhejiang (CN); Zhixiang Zeng, Zhejiang (CN); Qifeng Ye, Zhejiang (CN); Shuanglang Li, Zhejiang (CN); Zhaosong Lin, Zhejiang (CN); Dingkai Wang, Zhubei (CN); Weijun Zhu, Zhejiang (CN)

(73) Assignee: Jiaxing Super Lighting Electric Appliance Co., Ltd., Jiaxing, Zhejiang (CN)

( * ) Notice: Subject to any disclaimer, the term of this patent is extended or adjusted under 35 U.S.C. 154(b) by 0 days.

(21) Appl. No.: 15/308,995

(22) PCT Filed: Sep. 25, 2015

(86) PCT No.: PCT/CN2015/090815
§ 371 (c)(1),
(2) Date: Nov. 4, 2016

(87) PCT Pub. No.: WO2016/045631
PCT Pub. Date: Mar. 31, 2016

(65) Prior Publication Data

US 2017/0074462 A1 Mar. 16, 2017

(30) Foreign Application Priority Data

Sep. 28, 2014 (CN) ..... 2014 1 0510593
Feb. 2, 2015 (CN) ..... 2015 1 0053077
Aug. 7, 2015 (CN) ..... 2015 1 0489363
Sep. 2, 2015 (CN) ..... 2015 1 0555889

(51) Int. Cl.
*F21V 1/00* (2006.01)
*F21K 9/232* (2016.01)
(Continued)

(52) U.S. Cl.
CPC ..... *F21K 9/232* (2016.08); *F21K 9/237* (2016.08); *F21K 9/238* (2016.08); *F21V 3/02* (2013.01);
(Continued)

(58) Field of Classification Search
CPC ..... F21K 9/232; F21K 9/237; F21K 9/238; F21V 23/005; F21V 3/02; F21V 7/22; F21V 25/00; F21Y 2105/12; F21Y 2115/10
(Continued)

(56) References Cited

U.S. PATENT DOCUMENTS

2009/0059559 A1 3/2009 Pabst et al.
2011/0194282 A1* 8/2011 Paik ..... F21V 5/007 362/245
(Continued)

FOREIGN PATENT DOCUMENTS

CN 201386926 1/2010
CN 201386926 Y 1/2010
(Continued)

*Primary Examiner* — William J Carter
*Assistant Examiner* — Omar Rojas Cadima
(74) *Attorney, Agent, or Firm* — Muir Patent Law, PLLC

(57) ABSTRACT

An LED lamp bulb, comprising: an LED lamp substrate (5) having at least one LED light source (51) mounted thereon; and an electrical isolation assembly (6*a*) disposed on the LED lamp substrate (5), wherein, the electrical isolation assembly (6*a*) electrically isolates the LED lamp substrate's charged part from outside of the LED lamp substrate (5). The LED lamp bulb can protect user from contacting the charged part inside the lamp housing (7) when the LED lamp
(Continued)

bulb is broken and thereby avoid electric shock accidents. In addition, the directions of the light emitted by the LED light sources (51) can be changed to achieve different kinds of lighting effects.

23 Claims, 8 Drawing Sheets

(51) Int. Cl.

| | |
|---|---|
| ***F21V 25/00*** | (2006.01) |
| ***F21K 9/238*** | (2016.01) |
| ***F21K 9/237*** | (2016.01) |
| ***F21V 3/02*** | (2006.01) |
| ***F21V 7/22*** | (2018.01) |
| *F21Y 115/10* | (2016.01) |
| *F21Y 105/12* | (2016.01) |

(52) U.S. Cl.
CPC ..... *F21V 7/22* (2013.01); *F21V 25/00* (2013.01); *F21Y 2105/12* (2016.08); *F21Y 2115/10* (2016.08)

(58) Field of Classification Search
USPC ... 362/235, 249.02, 326, 327, 335, 341, 347
See application file for complete search history.

(56) References Cited

U.S. PATENT DOCUMENTS

2011/0234078 A1* 9/2011 Choi ..... F21K 9/00 313/46
2012/0049732 A1 3/2012 Chuang
2012/0182723 A1 7/2012 Sharrah et al.
2012/0268936 A1 10/2012 Pickard et al.
2012/0273812 A1* 11/2012 Takahashi ..... F21V 7/0016 257/88
2012/0287632 A1* 11/2012 Takahashi ..... F21V 23/006 362/235
2013/0027928 A1* 1/2013 Kang ..... F21K 9/232 362/235
2013/0027939 A1* 1/2013 Hisayasu ..... F21V 17/164 362/249.02
2013/0335966 A1* 12/2013 Yokota ..... F21V 3/02 362/235
2014/0043828 A1* 2/2014 Yokota ..... F21V 3/02 362/311.02
2014/0153252 A1* 6/2014 Shida ..... F21V 17/101 362/294
2015/0109778 A1* 4/2015 Yokotani ..... F21K 9/232 362/235
2015/0176830 A1 6/2015 Liang
2016/0123571 A1 5/2016 Chan et al.

FOREIGN PATENT DOCUMENTS

| | | | |
|---|---|---|---|
| CN | 203177056 | | 9/2013 |
| CN | 203177056 | U | 9/2013 |
| CN | 203298129 | | 11/2013 |
| CN | 203298129 | U | 11/2013 |
| CN | 203848128 | | 9/2014 |
| CN | 203848128 | U | 9/2014 |
| JP | 2010062005 | A | 3/2010 |
| JP | 2013201041 | | 10/2013 |
| JP | 2013201041 | A | 10/2013 |
| WO | 2013082223 | A1 | 6/2013 |

* cited by examiner

LED BULB LAMP

CROSS-REFERENCE TO RELATED APPLICATIONS AND PRIORITY CLAIM

This application claims the benefit under 35 U.S.C. § 371 to International Application Number PCT/CN2015/090815 filed on Sep. 25, 2015 which claims the priority of Chinese Patent Application No. '201410510593.6', filed on Sep. 28, 2014, Chinese Patent Application No. '201510053077.X', filed on Feb. 02, 2015, Chinese Patent Application No. '201510489363.0', filed on Aug. 07, 2015, and Chinese Patent Application No. '201510555889.4', filed on Sep. 02, 2015 The entire disclosures of said applications are incorporated by reference herein for all purposes.

FIELD OF THE INVENTION

The disclosure relates to the lighting field, in particular, an LED bulb lamp.

BACKGROUND

LED lamps have the advantages of long service life, small size and environmental protection, etc., so their applications are increasing more and more. However, the light emitting surface of the LED lamps generally is small due to the LED packaging holder and the substrate which blocks the light, and the LED lamps presents the status of lighting in half of circumference where the angle of the light distribution is less than 180 degree.

To achieve a similar light distribution with incandescent lamp of which the light distribution is more than 180 degree, some LED bulb lamps adopt COB (Chip On Board) integrated light sources and is configured with light distribution lens, and some adopt SMD (Surface Mount Technology) light sources arranged on the substrate in an encircling manner . Nevertheless, the light shape curves of these LED bulb lamps are not smooth and have higher local jitter, which result in a situation in which the brightness transits unevenly.

In addition, the traditional LED bulb lamp generally has a glass lamp housing which is fragile and the glass fragments can hurt users easily, further, after being broken, the exposed and charged part in the lamp body, such as the light source, solder joints on the substrate or the wires on the lamp substrate etc., will lead to an accident of electric shock easily and result in the risk of personal safety.

SUMMARY OF THE INVENTION

The disclosure relates to an LED bulb lamp, comprising: an LED lamp substrate having at least one LED light source mounted thereon; and an electrical isolation assembly disposed on the LED lamp substrate, wherein, the electrical isolation assembly electrically isolates the LED lamp substrate's charged part from outside of the LED lamp substrate.

Preferably, the electrical isolation assembly comprising: an electrical isolation unit covering the LED lamp substrate for electrically isolating the charged part on the LED lamp substrate from outside of the LED lamp substrate; and a light processing unit disposed on the electrical isolation unit for converting the outputting direction of the light emitted by the LED light sources.

Preferably, the electrical isolation unit and the light processing unit are integrally formed.

Preferably, the electrical isolation unit is made of electrically insulating materials with high reflectivity.

Preferably, the light processing unit is a cup-shaped structure comprising a main body, a bottom portion and a top portion, wherein the main body is between the bottom portion and top portion.

Preferably, the bottom portion is formed with a plurality of through holes, while electrical isolation unit is formed with a plurality of through holes corresponding to the through holes on the bottom portion and the LED light sources. The main body comprises a reflecting surface formed on an inside surface of the main body, and the LED light sources on the LED lamp substrate are arranged inside the main body in an encircling manner, so that the light emitted by each of the LED light sources is reflected towards inside of the main body by the reflecting surface.

Preferably, the electrical isolation assembly further comprises an extending portion which is outwardly extended from the circumferential of the bottom portion and arranged to the light processing unit, and the extending portion is formed with a plurality of through holes, while the electrical isolation unit is formed with a plurality of through holes corresponding to the through holes on the bottom portion and the LED light sources on the LED lamp substrate. The main body comprises a reflecting surface formed on an outside surface of the main body, and the LED light sources on the LED lamp substrate are arranged outside the main body in an encircling manner, so that the light emitted by each of the LED light sources is reflected towards outside of the main body by the reflecting surface.

Preferably, the bottom portion is hollowed out and the main body is a camber surface. The main body comprises a reflecting surface formed on an outside surface of the main body, and wherein, the LED light sources on the LED lamp substrate are arranged under the light processing unit in an encircling manner so that one part of each of the LED light sources are exposed outside the main body, one part are located under the main body and the rest are exposed inside the main body, such that the light emitted by the part of each of the LED light sources exposed outside the main body is reflected towards outside of the main body by the reflecting surface, the light emitted by the part of each of the LED light sources located under the main body go towards the outside right along the main body from the bottom up, and the light emitted by the rest of each of the LED light sources exposed inside the main body are outputted directly towards the lamp housing of the LED bulb lamp.

Preferably, the main body is a camber surface and the main body comprises a reflecting surface formed on an outside surface of the main body, and wherein, the LED light sources on the LED lamp substrate are arranged under the light processing unit in an encircling manner so that one part of the LED light sources are exposed outside the main body, one part are located under the main body, such that the light emitted by the part of each of the LED light sources exposed outside the main body are reflected towards outside of the main body by the reflecting surface, and the light emitted by the part of each of the LED light sources located under the main body go towards outside right along the main body from the bottom up.

Preferably, the bottom portion is formed with a plurality of through holes, while the electrical isolation unit is formed with a plurality of through holes corresponding to the through holes on the bottom portion and the LED light sources. The main body is a camber surface and the main body comprises a reflecting surface formed on an outside surface of the main body, and wherein the LED lamp substrate include two sets of LED light sources distributed in an encircling manner, wherein, the first set of LED light sources are arranged inside the main body in an encircling manner and the light emitted by each of the light sources of this set are outputted directly to the lamp housing of the LED bulb lamp, and wherein, the second set of LED light sources are arranged under the light processing unit in an encircling manner so that one part of the LED light sources in this set are exposed outside the main body, one part are located under the main body, such that the light emitted by the part of each of the LED light sources exposed outside the main body are reflected towards outside of the main body by the reflecting surface, and the light emitted by the part of each of the LED light sources located under the main body go towards outside right along the main body from the bottom up, wherein, the first set of the LED light sources are corresponding to the through holes formed on the bottom portion.

Preferably, the bottom portion is formed with a plurality of through holes, while the electrical isolation unit is formed with a plurality of through holes corresponding to the through holes on the bottom portion and the LED light sources. The main body is a camber surface, and the main body comprises a reflecting surface formed on an outside surface and an inside surface of the main body, and wherein, the LED lamp substrate includes two sets of LED light sources distributed in an encircling manner , wherein, the first set of LED light sources are exposed inside the main body in an encircling manner and the light emitted by each of the light sources of this set is reflected towards inside of the LED bulb lamp by the reflecting surface of the inside surface, and wherein, the second set LED light sources are arranged under the light processing unit in an encircling manner so that one part of each of the LED light sources in this set are exposed outside the main body and one part are located under the main body, such that the light emitted by the part of each of the LED light sources is reflected towards outside direction of the main body by the reflecting surface of the outside surface, and the light emitted by the part of each of the LED light sources located under the main body go toward outside right along the main body from the bottom up, wherein, the first set of LED light sources are corresponding to the through holes formed on the bottom portion.

Preferably, the bottom portion is formed with a plurality of through holes, while the electrical isolation unit is formed with a plurality of through holes corresponding to the through holes on the bottom portion and the LED light sources. In addition, the electrical isolation assembly further comprises a extending portion which is outwardly extended from the circumferential of the bottom portion and arranged to the light processing unit, wherein, the extending portion is formed with a plurality of through holes, while the electrical isolation unit is formed with a plurality of through holes corresponding to the through holes on the extending portion and the LED light sources on the LED lamp substrate. The main body comprises a reflecting surface formed on an outside surface of the main body, and wherein, the LED lamp substrate includes two sets of LED light sources distributed in an encircling manner , wherein, the first set of LED light sources are arranged inside the main body in an encircling manner and the light emitted by each of the light sources of this set are outputted to the lamp housing of the LED bulb lamp directly, and wherein, the second set of LED light sources are arranged outside the cut body in an encircling manner, so that the light emitted by each of the LED light sources in this set is reflected towards outside of the main body by the reflecting surface, wherein, the first set of LED light sources are corresponding to the through holes formed on the bottom portion, and the second set of LED light sources are corresponding to the through holes formed on the extending portion.

Preferably, the bottom portion is formed with a plurality of through holes, while the electrical isolation unit is formed with a plurality of through holes corresponding to the through holes on the bottom portion and the LED light sources. In addition, the electrical isolation assembly further comprises an extending portion which is outwardly extended from the circumferential of the bottom portion and arranged to the light processing unit, and the extending portion is formed with a plurality of through holes, while the electrical isolation unit is formed with a plurality of through holes corresponding to the through holes on the extending portion and the LED light sources on the LED lamp substrate. The main body comprises a reflecting surface formed on an outside surface and an inside surface of the main body, and wherein, the LED lamp substrate includes two sets of LED light sources distributed in an encircling manner, wherein, the first set of LED light sources are arranged inside the main body in an encircling manner and the light emitted by each of the light sources of this set is reflected towards inside of the LED bulb lamp by the reflecting surface of the inside surface, and wherein, the second set of LED light sources are arranged outside the main body in an encircling manner, so that the light emitted by each of the LED light sources in this set is reflected towards outside of the main body by the reflecting surface of the outside surface, wherein, the first set of LED light sources are corresponding to the through holes formed on the bottom portion, the second set of LED light sources are corresponding to the through holes formed on the extending portion.

Preferably, in the various embodiments discussed above, the size of the through hole on the bottom portion and the extending portion is equal to or slightly bigger than the size of the LED light source.

Preferably, the LED bulb lamp further comprises a lamp housing, wherein, the inside surface or outside surface of the lamp housing or both are coated with an adhesive film, and the thickness of the adhesive film is related to total weight of the LET bulb lamp. In one embodiment, the thickness of the adhesive film is 200 μm~300 μm if the total weight of the LET bulb lamp is larger than 100 g. In another embodiment, the thickness of the adhesive film is 40 μm~90 μm if the total weight of the LET bulb lamp is smaller than 80 g.

Preferably, the LED bulb lamp further comprises a lamp housing, wherein, the inside surface or outside surface of the lamp housing or both are coated with a diffusion film. In one embodiment, the main ingredient of the diffusion film is selected from at least one of calcium carbonate, calcium halophosphate and aluminum oxide.

Preferably, the LED bulb lamp further comprises a lamp housing, wherein, the inside surface of the lamp housing is coated with a reflecting film, the reflecting film being coated in an area which has a certain angle with the central axis of the LED bulb lamp. In an embodiment, the main ingredient of the reflecting film is barium sulfate. In an embodiment, the angle is in the range of 0 degree~60 degree. In a embodiment, the angle is in the range of 0 degree~45 degree. In an embodiment, the thickness of the reflecting film can gradually reduced from the central axis of the LED bulb lamp.

According to the LED bulb lamp of the disclosure, it can protect user from contacting the charged part inside the lamp housing when the LED bulb lamp is broken and thereby avoid electric shock accidents. In addition, the directions of the light emitted by the LED light sources can be changed to achieve different kinds of lighting effects according to the LED bulb lamp of the disclosure.

DETAILED DESCRIPTION

In order to make the objects, technical solutions and advantages of the invention more apparent, the invention will be further illustrated in details in connection with accompanying figures and embodiments hereinafter. It should be understood that the embodiments described herein are just for explanation, but not intended to limit the invention.

Figure 1:
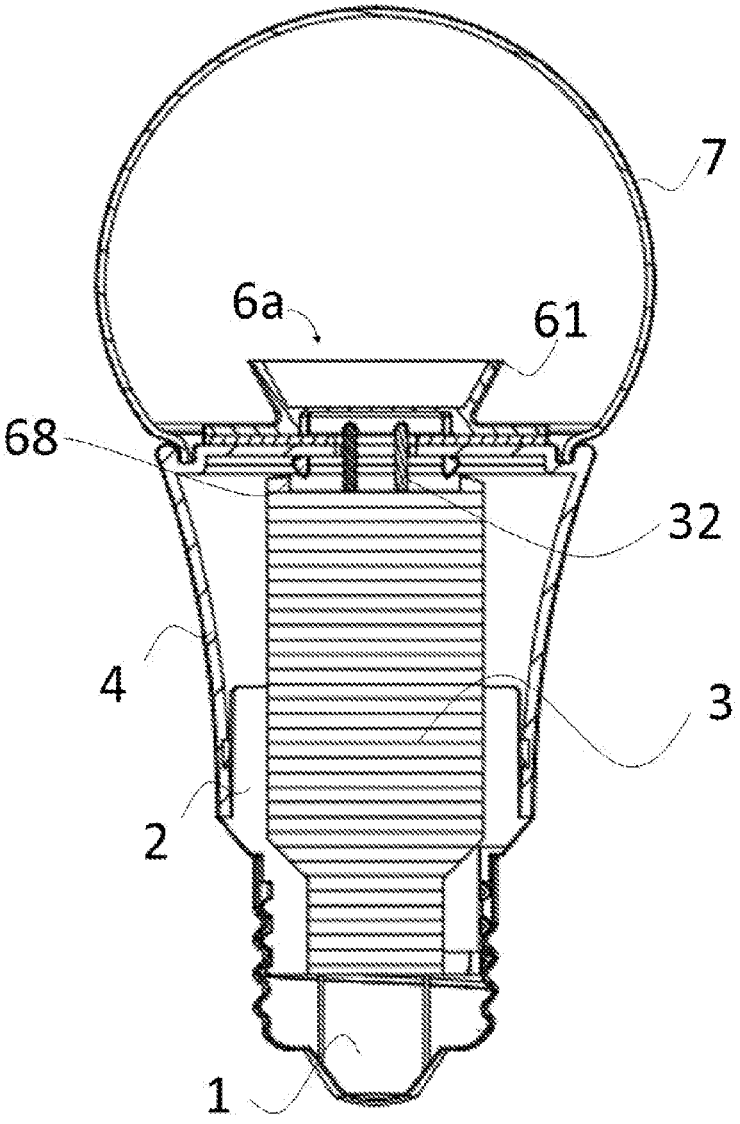
FIG. 1 illustrates a longitudinal sectional view of the LED bulb lamp along the central axis according to an embodiment.
Figure 2:
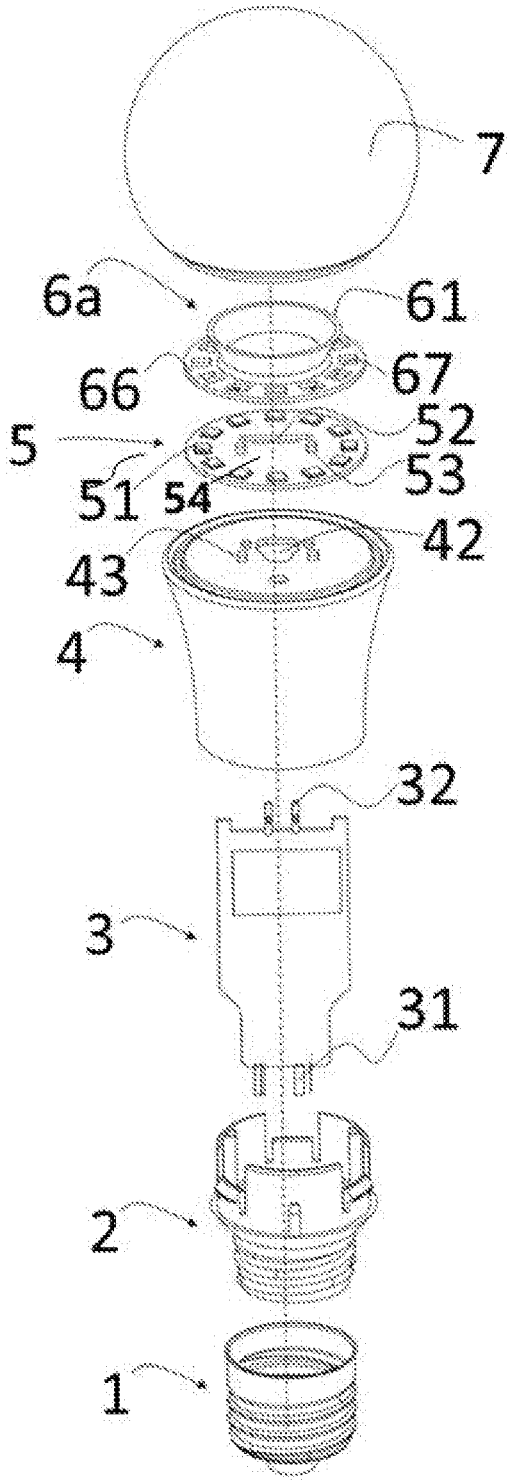
FIG. 2 illustrates an exploded view of the LED bulb lamp according to an embodiment.
Figure 3:
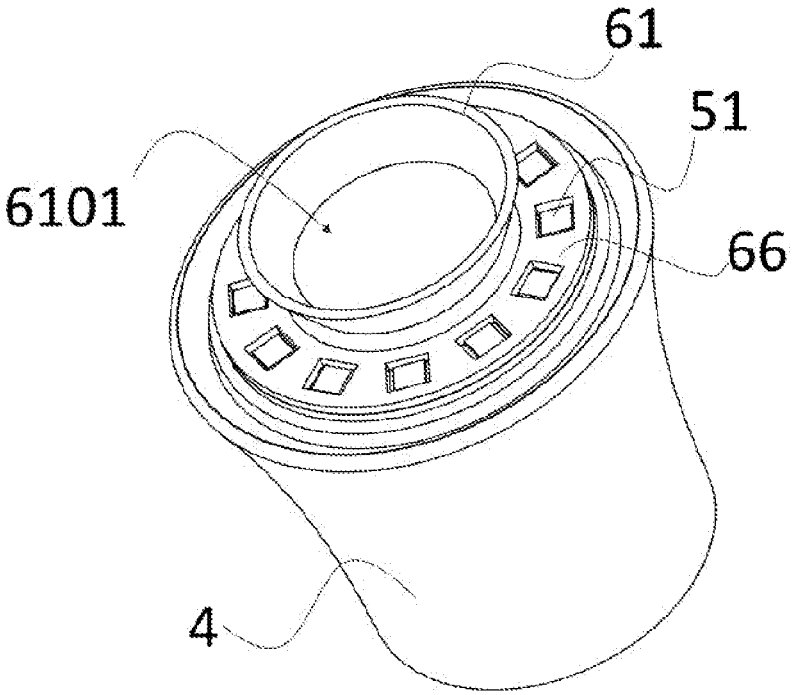
FIG. 3 illustrates a structural schematic view of the electrical isolation assembly, the LED lamp substrate and the radiator after being assembled together according to an embodiment.
Figure 4:
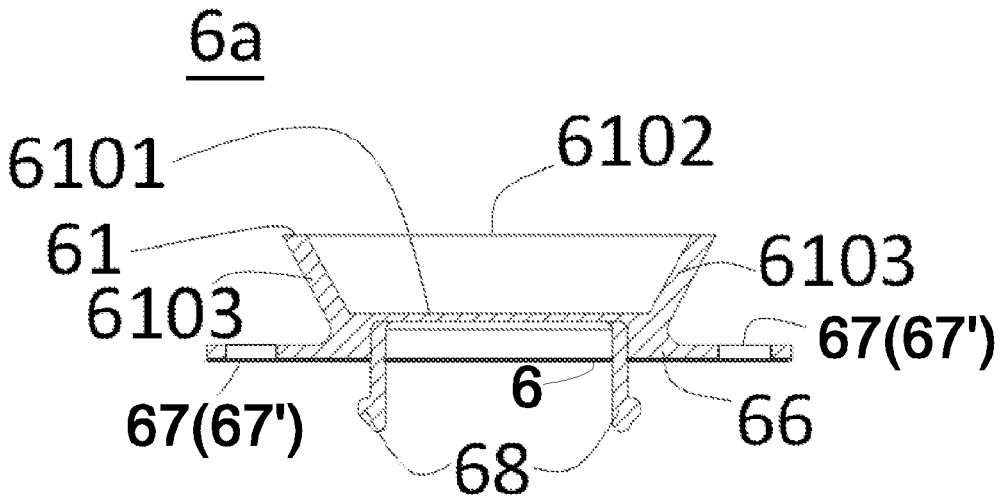
FIG. 4 illustrates a longitudinal sectional view of the electrical isolation assembly along the central axis according to an embodiment.
Figure 5:
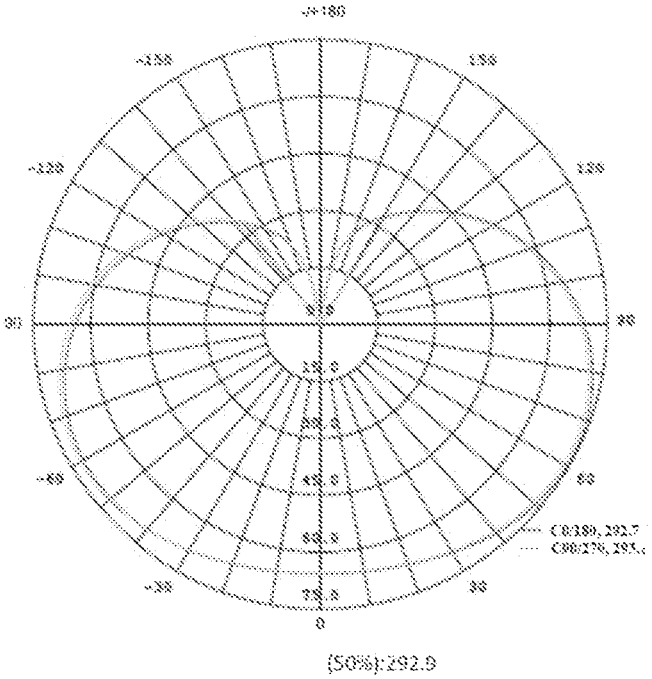
FIG. 5 illustrates an exemplary light distribution curve view of the LED bulb lamp according to an embodiment.

Referring to FIG. 1 to FIG. 6, an LED bulb lamp is provided according to an embodiment of this invention, wherein, FIG. 1 illustrates a longitudinal sectional view of the LED bulb lamp along the central axis according to an embodiment; FIG. 2 illustrates an exploded view of the LED bulb lamp according to an embodiment; FIG. 3 illustrates a structural schematic view of the electrical isolation assembly, the LED lamp substrate and the radiator after being assembled together according to an embodiment; FIG. 4 illustrates a longitudinal sectional view of the electrical isolation assembly along the central axis according to an embodiment; and FIG. 5 illustrates an exemplary light distribution curve view of the LED bulb lamp according to an embodiment.

Referring to FIG. 1 and FIG. 2, the LED bulb lamp comprises a lamp head 1, a base 2, an LED driving power supply 3, a radiator 4, an LED lamp substrate 5, an electrical isolation assembly 6*a,* and a lamp housing 7.

One end of the base 2 embeds into the lamp head 1, and the other end of the base 2 embeds into one end of the radiator 4 away from the lamp housing lamp housing 7. In one embodiment, the ends of the base 2 and the radiator 4 that are connected can be formed with lock structures such that the base can be locked with the radiator. The base 2 is with an electrical connection structure inside to enable the LED driving power supply 3 placed within the radiator 4 to electrically connect with the lamp head 1.

The LED driving power supper 3 is arranged between the base 2 and the radiator 4. The LED driving power supper 3 has input wires 31 on its end closer to the base 2 (input end). The input wires 31 are electrically connected with the lamp head 1 via the base 2. The LED driving power supper 3 has an output wire 32 on the other end closer to the radiator 4 (output end). The output wire 32 is electrically connected with the LED lamp substrate 5. Thus the current flows to the input wires 31 of the LED driving power supply 3 via the lamp head 1, and then flows to the output wires 32 of the LED driving power supply 3 after voltage transformation by the LED driving power supply 3 to be supplied to the LED lamp substrate 5 to light the LED light sources 51 on the LED lamp substrate 5.

In some other embodiments, several columnar bulges are disposed on the end of the LED driving power source 3 closer to the radiator 4 instead of the outputs wires 32, the top outside surface of the columnar bulges has been conductively treated, and the columnar bulges are connected with a conductive fiberglass panel which in turn is connected with the LED lamp substrate 5 electrically. Thus, the current flows to the input wires 31 of the LED driving power supply 3 via the lamp head 1, and then flows to the columnar bulges of the LED driving power supply 3 after voltage transformation by the LED driving power supply 3 and is supplied to the LED lamp substrate 5 via the conductive fiberglass to light the LED light sources 51 on the LED lamp substrate 5. In these embodiments, the electrical connection of the LED driving power source 3 with the LED lamp substrate 5 can be completed by welding process, i.e., the LED lamp substrate 5 is welt on the columnar bulges of the LED driving power source 3.

Next referring to FIG. 1 and FIG. 2, the end of the radiator 4 away from the lamp housing 7 is embedded with the base 2, and the end of the radiator 4 away from the lamp head 1 is connected with the LED lamp substrate 5. Via holes 42 are formed on the radiator 4. The via holes 42 correspond to the output wires 32 of the LED driving power supply 3, and the output wires 32 of the LED driving power supply 3 can cross through the via hole 42 up and down. In addition, the via holes 42 also are corresponding to the via holes 52 formed on the LED lamp substrate 5 so that the output wires 32 of the LED driving power supply 3 can electrically connect with the LED lamp substrate 5 through the corresponding via holes 42 and via holes 52 in order. Further, fixing elements 43 are disposed on the end of the radiator 4 away from the lamp head 1. The fixing elements 43 are corresponding to the fixing element 53 disposed on the LED lamp substrate 5 and the fixing element 68 disposed on the electrical isolation assembly 6*a* to enable the electrical isolation assembly 6*a* to connect with the LED lamp substrate 5 and the radiator 4.

The LED lamp substrate 5 is placed on the end of the radiator 4 closer to the lamp housing 7, and the LED lamp substrate 5 can be disposed with the electrical isolation assembly 6*a* at firstly, and then disposed on the radiator 4. The LED lamp substrate 5 can be circularly shaped. At least one light resource 51, which may have the traditional appearance with holder and gluey shell, chip scale package or other package structure, is mounted on the LED lamp substrate 5. In addition, as described above, the LED lamp substrate 5 has the via holes 52 formed thereon, and the via holes 52 are corresponding to the via holes 42 on the radiator 4. The output wires 32 of the LED driving power supply 3 can electrically connect with the LED lamp substrate 5 through the corresponding via holes 42 and via holes 52 in order. Further, as described above, the LED lamp substrate 5 has the fixing element 53 disposed thereon, the fixing elements 53 are corresponding to the fixing elements 43 on the radiator 4 and the fixing elements 68 on the electrical isolation assembly 6*a* to enable the electrical isolation assembly 6*a* to disposed on the LED lamp substrate 5 and the radiator 4.

In one embodiment, the numbers of via holes 42 and the via holes 52 depends on the number of the output wires 32 of the LED driving power supply 3, generally, these via holes can be the holes corresponding to two output wires, the anode and the cathode. If the LED driving power supply 3 has the Dimming function of adjusting the brightness of the light sources 51 or in other use cases where an increased electrical connection wires are required, the wires and the corresponding holes can be increased accordingly.

The electrical isolation assembly 6*a* is disposed on the LED lamp substrate 5 for isolating the charged part 54 on the LED lamp substrate 5 from outside. The electrical isolation assembly 6*a* further includes an electrical isolation unit 6. Several through holds 67' are formed on the electrical isolation unit 6, and these through holds 67' are corresponding to the through holes on the bottom portion and the LED light sources 51 on the LED lamp substrate 5 such that the light emitted from the LED light sources 51 can cross through these through holds 67'. When the electrical isolation assembly 6*a* is disposed on the LED lamp substrate 5, the electrical isolation unit 6 covers the LED lamp substrate 5 for electrically isolating the charged part 54 on the LED lamp substrate 5 from outside of the LED lamp substrate 5. In an embodiment, the electrical isolation unit 6 can be an electrical isolation board made from electrically insulating materials with high reflectivity, such as polycarbonate (PC).

The electrical isolation assembly 6*a* can further comprise a light processing unit 61 which can convert the outputting direction of the light emitted by the LED light sources 51. When the electrical isolation assembly 6*a* is disposed on the LED lamp substrate 5, the light processing unit 61 is disposed on the electrical isolation unit 6, that is, the electrical isolation unit 6 is located between the light processing unit 61 and the LED lamp substrate 5. The light processing unit 61 and with the electrical isolation unit 6 can be integrally formed.

Next, referring to FIG. 3 and FIG. 4, the light processing unit 61 has a cup-shaped structure when being seen as a whole. The light processing unit 61 comprises a bottom portion 6101, a main body 6103 and a cut top 6102, wherein, the main body 6103 is formed between the bottom portion 6101 and the top portion 6102. It should be understood that the light processing unit 61 is described here to include the top portion 6101, but in fact, the top of the light processing unit 61 is hollowed out, and the boundary line just is seen from the longitudinal sectional view. In the embodiment, the preferably external diameter of the bottom portion 6101 is 16 mm~20 mm and the preferably external diameter of the top portion 6102 is 25 mm~29 mm. The outside surface's side boundary of the main body 6103 is approximately a straight line and has a certain angle with the extending surface of the bottom portion 6101. In one embodiment, the angle can be 51 degree~73 degree. It should be understood that the outside surface of the main body 6103 can also be other shapes which are good for reflecting light.

The electrical isolation assembly 6*a* further comprises an extending portion 66 which is extended outwardly from the circumferential of the main body 6103 and arranged to the light processing unit 61 in an encircling manner. The extending portion 66 is formed with at least one through holes 67 which are radially formed on the extending portion 66 in an encircling manner and are corresponding to the LED light sources 51 on the LED lamp substrate 5. Accordingly, these through holds 67 are also corresponding to the through holds 67' of the electrical isolation unit 6. When the electrical isolation assembly 6*a* is disposed on the LED lamp substrate 5, the light sources 51 on the LED lamp substrate 5 can cross through the corresponding through holes 67' on the electrical isolation unit 6 and embeds into the through holes 67 of the extending portion 66.

In this embodiment, the through holes 67 can be, but is not limited to, arranged evenly along the outside of the main body 6013. The through holes 67 may have rectangle shape or circular shape, etc,. The depth of each of the through holes 67 can be equal or higher than the height of the LED light sources 51. In one embodiment, the depth of each through hole 67 can be 100%-120% of the height of the LED light sources 51 to make sure the through holes 67 can meet the required light transmittance. In addition, the cross sectional area of each of the through holes 67 can be equal to or bigger than the bottom area of each of the LED light sources 51. In one embodiment, the cross sectional area of the through hole 67 is 100%~120% of the bottom area of the LED light source 51 to make sure the through hole 67 would not block the light emitted by the LED light sources 51.

By the way of embedding the LED light sources 51 into the through holes 67 of the extending portion 66, the LED light sources 51 are arranged outside the main body 6103 in an encircling manner so that the emitted light is distributed outside the main body 6103 of the light processing unit 61 when the LED light source 51 is lighting. It should be noted that, in this embodiment, a reflecting surface is formed on the outside surface of the main body 6103 to reflect the light emitted by the LED light sources 51 towards outside of the main body 6103 so that the range of the light distribution of the LED light sources 51 can be more than 180 degree.

As described above, the preferably external diameter of the bottom portion 6101 of the light processing unit 61 is 16 mm~20 mm and the preferably external diameter of the top portion 6102 of the light processing unit 61 is 25 mm~29 mm. If the external diameter of the top portion 6102 is bigger than 29 mm, a light spot will be generated on the top of the lamp housing 7 when all the LED light sources 51 on the LED lamp substrate 5 are lighting, even though the requirement of the standard for the light distribution of the LED bulb lamp can be met, the whole illumination effect of the LED bulb lamp will be affected. Further, as described before, the outside surface's side boundary of the main body 6103 has an angle of 51 degree~73 degree with the extending surface of the bottom portion 6101. If the angle is less than 51 degree, the whole illumination effect of the LED bulb lamp will decrease, even though the requirement of the standard for the light distribution of the LED bulb lamp can be met.

Referring to FIG. 4, fixing elements 68 are disposed on the bottom portion 6101 of the light processing unit 61 of the electrical isolation assembly 6*a*. The fixing elements 68 can cross through the electrical isolation unit 6, and then can be fixed with the fixing elements 53 on the LED lamp substrate 5 and the fixing elements 43 on the radiator 4 to connect the electrical isolation assembly 6*a* with the LED lamp substrate 5 and then to connect with the radiator 4. It should be understood that the electrical isolation assembly 6*a* can include the electrical isolation unit 6 only (i.e. does not includes the light processing unit 61), and in such case, the fixing elements 68 can be disposed on the electrical isolation unit 6.

In an embodiment, each of the fixing elements 68, the fixing elements 53 and the fixing elements 43 can be a lock structure to achieve the lock connection of the electrical isolation assembly 6*a* with the LED lamp substrate 5 and the radiator 4. However, it should be understood that the electrical isolation assembly 6*a,* the LED lamp substrate 5 and the radiator 4 can be fixed and connected in other ways, for example, through screw or silicone connection.

When the electrical isolation assembly 6*a* is disposed on the LED lamp substrate 5 via the fixing elements 68, the through holes 67 on the extending portion 66 are exactly embedded with the corresponding LED light sources 51 on the LED lamp substrate 5. Generally, there are some charged part such as the welding points and the conductive wires on the LED lamp substrate 5 for electrically connecting the LED lamp substrate 5 to the LED driving power supply 3, and there are some active and passive elements on the LED driving power supply 3 too. Thus, it's easy for users to contact the charged part inside the LED bulb lamp and get an electric shock accident after the lamp housing 7 is broken. In this embodiment, an electric insulation design is used for the electrical isolation unit 6, the extending portion 66 and the fixing elements 68, so that the whole electrical isolation assembly 6*a* can isolate the charged part on the LED lamp substrate 5 such that the charged part will not be exposed to outside even the lamp housing 7 is broken, then users will not get an electric shock accident due to contacting these charged part.

Back to FIG. 1 and FIG. 2, the lamp housing 7 is disposed on the end of the radiator 4 away from the base 2. And the lamp housing 7 can connect with the radiator 4 by an adhesive film.

An LED bulb was described above according to an embodiment of this invention. The experimental data of the distribution of luminous intensity of the LED bulb lamp according to this embodiment is as shown in FIG. 5. As can be seen in the FIG. 5, the distribution of luminous intensity of the LED bulb lamp is distributed in the scope of 0 degree~135 degree, and 90.5% of the luminous intensity measurements (cd) have a difference with the average value of all the measurements no more than 25%, which is above the requirement of the standard (i.e., in the scope of 0 degree~135 degree, 90% of the luminous intensity measurements (cd) have a difference with the average value of all the measurements no more than 25%). In addition, as can be seen in the FIG. 5, the luminous flux in the scope of 135 degree~180 degree is 5.3%-9.5% of the total luminous flux, which is also above the requirement of the standard (the luminous flux in the scope of 135 degree~180 degree should be no less than 5% of the total luminous flux).

Figure 6:
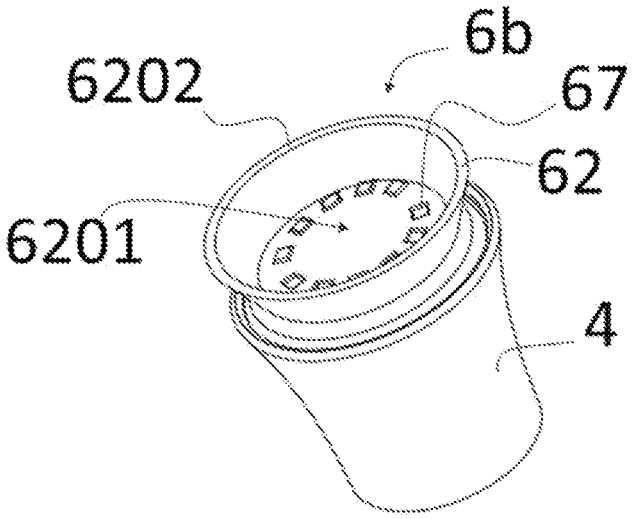
FIG. 6 illustrates a structural schematic view of the electrical isolation assembly, the LED lamp substrate and the radiator after assembling according to another embodiment.
Figure 7:
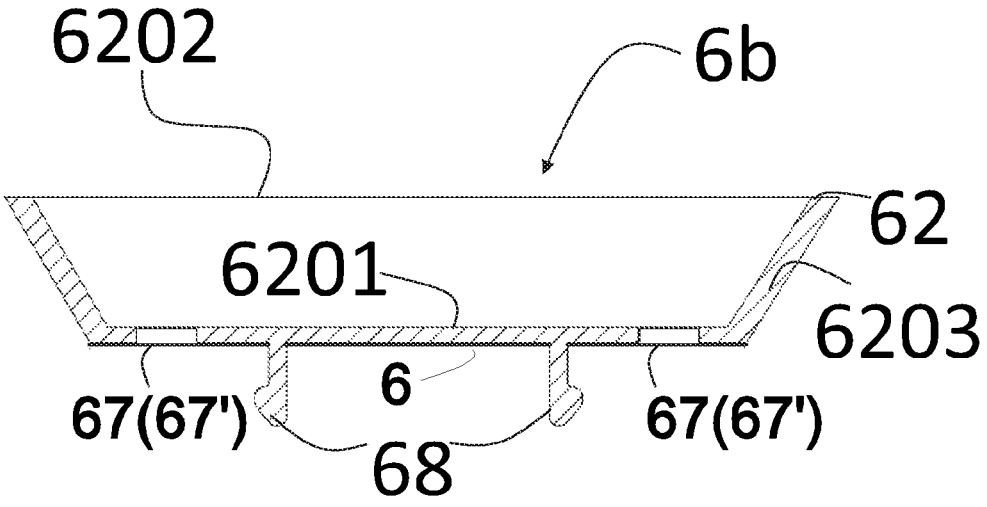
FIG. 7 illustrates a longitudinal sectional view of the electrical isolation assembly along the central axis according to another embodiment.

Referring to FIG. 6 and FIG. 7, an LED bulb lamp will be discussed according to another embodiment of this invention. FIG. 6 illustrates a structural schematic view of the electrical isolation assembly, the LED lamp substrate and the radiator after assembling according to another embodiment; and FIG. 7 illustrates a longitudinal sectional view of the electrical isolation assembly along the central axis according to another embodiment.

In the embodiment, except the electrical isolation assembly 6*b* and the LED light sources 51 on the LED lamp substrate 5 have a different arrangement with the arrangement of the electrical isolation assembly 6*a* and the light sources 51 discussed referring to FIG. 1-5, the other assemblies comprising the lamp head 1, the base 2, the LED driving power source 3, the radiator 4, the LED lamp substrate 5 and the lamp housing 7, and their connection relationship can be the same with those in above embodiment.

To describe clearly and simply, these same assemblies are described herein briefly. One end of the base 2 embeds into the lamp head 1, and the other end of the base 2 embeds into the end of the radiator 4 away from the lamp housing 7. The LED driving power supply 3 is disposed inside of the base 2 and the radiator 4. The LED driving power supply 3 has input wires 31 in one end closer to the base 2 which are electrically connected to the lamp head 1 via the base 2. The LED driving power supply 3 has output wires 32 in the end closer to the radiator 4 which are electrically connected to the LED lamp substrate 5 via the radiator 4. The end the of the radiator 4 away from the lamp housing 7 is embedded with the base 2, and the other end away from the lamp head 1 connects with the LED lamp substrate 5. The LED lamp substrate 5 is disposed on the end of the radiator 4 closer to the lamp housing 7 and the electrical isolation assembly 6*b* is disposed on the LED lamp substrate 5. The lamp housing 7 is disposed on the end of the radiator 4 away from the base 2.

The differences of the electrical isolation assembly 6*b* with the electrical isolation assembly 6*a* of the above embodiment are: the electrical isolation assembly 6*b* comprises a light processing unit 62 instead of the light processing unit 61, and a reflecting surface is formed on inside surface of the main body 6203 of the light processing unit 62; the electrical isolation assembly 6*b* doesn't comprise the extending portion 66 and the through holes 67 formed on the extending portion 66, but at least one through holes 67 corresponding to the LED light sources 51 are formed on the bottom portion 6201 of the light processing unit 62. The LED light sources 51 on the LED lamp substrate 5 are radially arranged inside the main body 6203 in an encircling manner. The reflecting surface is formed on the inside surface of the main body 6203 of the light processing unit 62 to enable the light emitted by the LED light sources 51 is reflected towards inside of the main body 6203 to achieve the purpose of collecting light.

Specifically, the electrical isolation assembly 6*b* can comprises an electrical isolation unit 6. Several through holds 67' are formed on the electrical isolation unit 6, and these through holds 67' corresponding to the through holes on the bottom portion and the LED light sources 51 on the LED lamp substrate 5 such that the light emitted from the LED light sources 51 can cross through these through holds 67'. When the electrical isolation assembly 6*b* is disposed on the LED lamp substrate 5, the electrical isolation unit 6 covers the LED lamp substrate 5 for electrically isolating the charged part on the LED lamp substrate 5 from outside of the LED lamp substrate 5. Similarly, the electrical isolation unit 6 can be an electrical isolation board made from electrically insulating materials with high reflectivity, such as polycarbonate (PC).

Referring to FIG. 6 and FIG. 7, the electrical isolation assembly 6*b* can further comprise a light processing unit 62 which can convert the outputting direction of the light emitted by the LED light sources 51. When the electrical isolation assembly 6*b* is disposed on the LED lamp substrate 5, the light processing unit 62 is disposed on the electrical isolation unit 6, that is, the electrical isolation unit 6 is located between the light processing unit 62 and the LED lamp substrate 5. Similarly, the light processing unit 62 and the electrical isolation unit 6 can also be integrally formed.

The light processing unit 62 has a cup-shaped structure when being seen as a whole. The light processing unit 62 comprises a bottom portion 6201, a main body 6203 and a cut top 6202, wherein, the main body 6203 is formed between the bottom portion 6201 and the top portion 6202. Also, it should be understood that the light processing unit 62 is described here to include the top portion 6201, but in fact, the top of the light processing unit 62 is hollowed out, and the boundary line just is seen from the longitudinal sectional view. In the embodiment, the preferably external diameter of the bottom portion 6201 is 37 mm~40 mm which is the optimal size range for cooperating with the LED lamp substrate 5. In this embodiment, a reflecting surface is formed on an inside surface of the main body 6203, the light emitted by each of the LED light sources 51 is reflected towards inside of the main body 6203 by the reflecting surface. In an embodiment, the inside surface's side boundary of the main body 6203 is approximately a straight line and has a certain angle with the extending surface of the bottom portion 6201. In one embodiment, the angle can be 45 degree~75 degree to get the optimal effect of collecting light. But it should be understood that the inside surface of the main body 6203 can also be other shapes which are good for collecting light.

Several through holes 67 corresponding to the LED light sources 51 are formed on the bottom portion 6201 closer to the inside circumferential of the main body 6203. It should be understood that these through holds 67 are also corresponding to the through holds 67' on the electrical isolation unit 6. The number of the through holes 67, 67' is the same with the number of the LED light sources 51 on the LED lamp substrate 5. In one embodiment, the preferred number of the LED light sources 51 and the through holes 67, 67' is, but not is limited to, 4~12. The LED light sources 51 on the LED lamp substrate 5 can cross through the corresponding through holes 67' on the electrical isolation unit 6 and in turn embed into the through holes 67 on the bottom portion 6201 of light processing unit 62 when the electrical isolation assembly 6*b* is disposed on the LED lamp substrate 5.

Similarly, the through holes 67 may have rectangle shape or circular shape, etc,. The depth of each of the through holes 67 can be equal to or higher than the height of the LED light sources 51. In one embodiment, the depth of each through holes 67 can be 100%-120% of the height of the LED light sources 51. In addition, the cross sectional area of each of the through holes 67 can be equal to or bigger than the bottom area of each of the LED light sources 51. In one embodiment, the cross sectional area of the through hole 67 is 100%~120% of the bottom area of the LED light source 51.

By the way of embedding the LED light sources 51 into the through holes 67 formed on the bottom portion 6201, the LED light sources 51 are arranged inside the main body 6203 in an encircling manner so that the emitted light is distributed inside the main body 6203 of the light processing unit 62 when the LED light source 51 is lighting. It should be noted that, in this embodiment, the reflecting surface is formed on the inside surface of the main body 6203 to reflect the light emitted by the LED light sources 51 towards inside of the main body 6203 so that the angle range of the light distribution of the LED light sources 51 is less than 120 degree. In addition, a condenser can be arranged in the inside of the light processing unit 62 to enhance the effect of converging light.

Referring to FIG. 6 and FIG. 7, fixing elements 68 are disposed on the bottom portion 6201 of the light processing unit 62 by the electrical isolation assembly 6*b*. The fixing elements 68 can cross through the electrical isolation unit 6 , and then can be fixed with the fixing elements 53 on the LED lamp substrate 5 and the fixing elements 43 on the radiator 4 to connect the electrical isolation assembly 6*b* with the LED lamp substrate 5 and then to connect with the radiator 4. Similarly, it should be understood that the electrical isolation assembly 6*a* can include the electrical isolation unit 6 only (i.e. does not includes the light processing unit 62), and in such case, the fixing elements 68 can be disposed on the electrical isolation unit 6. Further, the fixing elements 68, the fixing elements 53 and the fixing elements 43 can be a lock structure to achieve the lock connection of the electrical isolation assembly 6*b* with the LED lamp substrate 5 and the radiator 4. The electrical isolation assembly 6*b*, the LED lamp substrate 5 and the radiator 4 can be fixed and connected in other ways, for example, through screw or silicone connection.

When the electrical isolation assembly 6*b* is disposed on the LED lamp substrate 5 via the fixing elements 68, the through holes 67 are exactly embedded with the corresponding LED light sources 51 on the LED lamp substrate 5. Generally, there are some charged part such as the welding points and the conductive wires on the LED lamp substrate 5 for electrically connecting the LED lamp substrate 5 to the LED driving power supply 3, and there are some active and passive elements on the LED driving power supply 3 too. Thus, it's easy for users to contact the charged part in the LED bulb lamp and get an electric shock accident after the lamp housing 7 is broken. In this embodiment, an electric insulation design is used for the electrical isolation unit 6 and the fixing elements 68, so that the whole electrical isolation assembly 6*b* can isolate the charged part on the LED lamp substrate 5 such that the charged part will not be exposed to outside even the lamp housing 7 is broken, then users will not get an electric shock accident due to contacting these charged part.

It should be noted that, in the two embodiments described above, according to the structure of the electrical isolation assembly 6*a* or 6*b*, the LED light sources 51 can arranged inside or outside the main body 6103, 6203 of the light processing unit 61, 62 in an encircling manner. Nevertheless, the disclosed LED bulb lamp can adopt different design.

Figure 8:
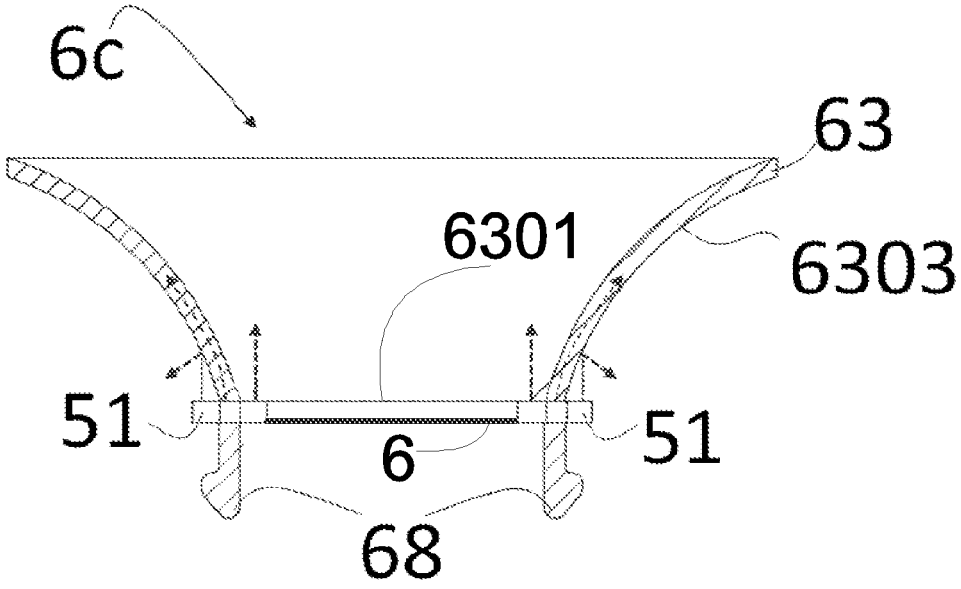
FIG. 8 illustrates a longitudinal sectional view of the electrical isolation assembly along the central axis according to yet another embodiment.

An LED bulb lamp is described bellow according to another embodiment referring to FIG. 8. FIG. 8 illustrates a longitudinal sectional view of the electrical isolation assembly along the central axis according to yet another embodiment.

In this embodiment, except the electrical isolation assembly 6*c* and the LED light sources 51 on the LED lamp substrate 5 have a different arrangement with the arrangement of electrical isolation assembly 6*a*, 6*b* and the light sources 51 described in above embodiments, the other assemblies and their connection relationship can be the same with those in above embodiments and need not be repeated here.

The main differences of the electrical isolation assembly 6*c* with the electrical isolation assembly 6*a* and 6*b* of the above embodiment are: the electrical isolation assembly 6*c* comprises a light processing unit 63, which has main body 6303 with non-straight camber surface, but does not have bottom portion 6301; the LED light sources 51 are arranged under the light processing unit 63 in an encircling manner. It should be understood that the bottom portion 6301 in the present embodiment is hollowed out, that is, there is no bottom portion 6301. The boundary line indicated by reference number 6301 in FIG. 8 just is shown in the longitudinal sectional view. Further, the electrical isolation unit 6 of the electrical isolation assembly 6*c* is shown lower than the bottom portion 6301, but in fact, the electrical isolation unit 6 is located between the main body 6303 and the LED light sources 51. Further, it should be understood that the main body 6303 may be other shape although a shape of camber surface is discussed here.

Specifically, a reflecting surface is formed on the outside of the camber surface of the main body 6303. And the light processing unit 63 of the electrical isolation assembly 6*c* is above the light sources 51 on the LED lamp substrate 5 when the electrical isolation assembly 6*c* is disposed on the LED lamp substrate 5, that is, the LED light sources 51 on the LED lamp substrate 5 are arranged under the light processing unit 63 in an encircling manner so that one part of each of the LED light sources 51 are exposed outside the main body 6303, one part are located under the main body 6303 and the rest are exposed inside the main body 6303.. Thus, the light emitted by the part of each of the light sources exposed outside the main body 6303 of the light processing unit 63 can be reflected by the reflecting surface on the outside surface of the main body 6303 towards outside of the main body 6303; the light emitted by the part of each of the light sources located under the main body 6303 of the light processing unit 63 can go towards outside along the camber surface of the main body 6303 from the bottom up due to refraction of the main body 6303; the light emitted by the part of each of the LED light sources exposed inside the main body 6303 of the light processing unit 63 can be outputted directly to the lamp housing 7 upwards without blocking of the bottom portion 6301.

In addition, as shown in the FIG. 8, the fixing elements 68 can be arranged under the circumferential of the main body 6301 of the light processing unit 63 to connect the electrical isolation assembly 6*c* with the LED lamp substrate 5 and the radiator 4. Similarly, it should be understood that the electrical isolation assembly 6*c* can include the electrical isolation unit 6 only (i.e. does not include the light processing unit 63), and in such case, the fixing elements 68 can be disposed on the electrical isolation unit 6.

In this embodiment, due to the camber surface design of the main body 6303 of the light processing unit 63, the design of the reflecting surface of the outside surface of the main body 6303, and the design of the main body 6303 of the light processing unit 63 located above the LED light sources 51, the range of the light distribution of the LED light sources can be more than 180 degree effectively.

As described above, the bottom portion 6301 is hollowed out and the light processing unit 63 can be arranged above the LED light sources 51 so that the light emitted by the LED light sources 51 will have the light emitting effect towards three directions after processed by the light processing unit 63. In another embodiment, the bottom portion 6301 may be present in fact and in such case, by arranging the light processing unit 63 over the LED light sources 51 such that a part of each LED light source 51 is exposed outside the main body 6303 and another part is located under the main body 6303, such that the light emitted by the part of each LED light source exposed outside of the main body 6303 will emits light towards two directions, and the light emitted by the part of each LED light source located under the main body 6303 will go towards outside along the camber surface of the main body 6303 from the bottom up. Thus, the light emitted by the LED light sources 51 will have the light emitting effect towards two directions after processed by the light processing unit 63.

In addition, different external diameter of the bottom portion 6301 of the light processing unit 63 and the length of the extend camber surface of the main body 6303 can be designed depending on the lighting requirement for the LED bulb lamp. For example, by adjusting the external diameters of the bottom portion 6301 of the light processing unit 63 or the length of the extend camber surface of the main body 6303, for example, the external diameter of the bottom portion 6301 is designed to be smaller to make the area of the LED light sources exposed outside the main body 6303 bigger, or the length or angle of the camber surface of the main body 6303 is designed to block more light emitted by the LED light sources, more of the light emitted by the LED light sources 51 will be reflected by the reflecting surface on the outside surface of the main body 6303, and thus higher brightness of the reflected light can be obtained accordingly.

Figure 9:
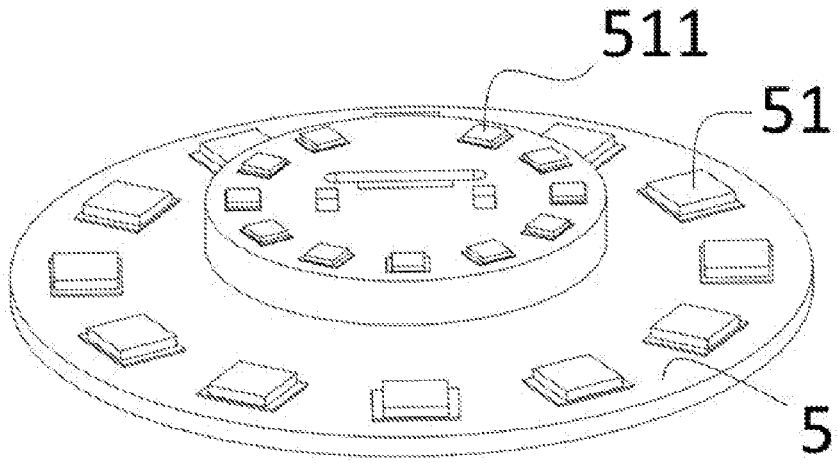
FIG. 9 illustrates a schematic view of the of the LED lamp substrate according to an embodiment.

As described above, one set of LED light sources 51 are mounted on the LED lamp substrate 5 in an encircling manner in the above embodiment. In some embodiments, two sets of LED light sources can be mounted on the LED lamp substrate 5 to form two encircling arrangements, as shown in FIG. 9. There are two sets of LED light sources on the LED lamp substrate 5, one set illustrated by the reference number 51 and the other set illustrated by the reference number 511. The two sets of LED light sources 51, 511 are both arranged around the center of the LED lamp substrate 5 in an encircling manner, wherein, the LED light sources 511 are closer to the center of the LED lamp substrate 5 and the LED light sources 51 are closer to the edge of the LED lamp substrate 5. Further, as shown in FIG. 9, the portion of the LED lamp substrate 5 mounted with the LED light sources 511 are on the LED lamp substrate 5 protrudes upward slightly as compared with the portion of the LED lamp substrate 5 mounted with the LED light sources 51 in order to be collocated with the electrical isolation assembly.

Figure 10:
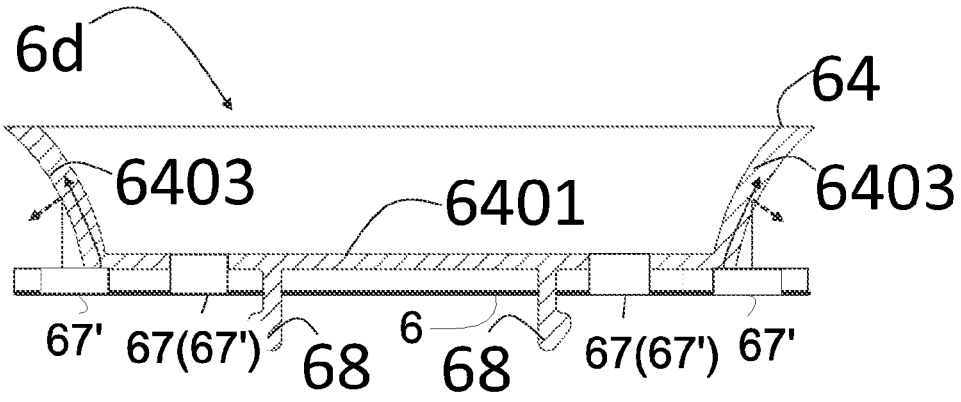
FIG. 10 illustrates a longitudinal sectional view of the electrical isolation assembly along the central axis according to yet another embodiment.
Figure 11:
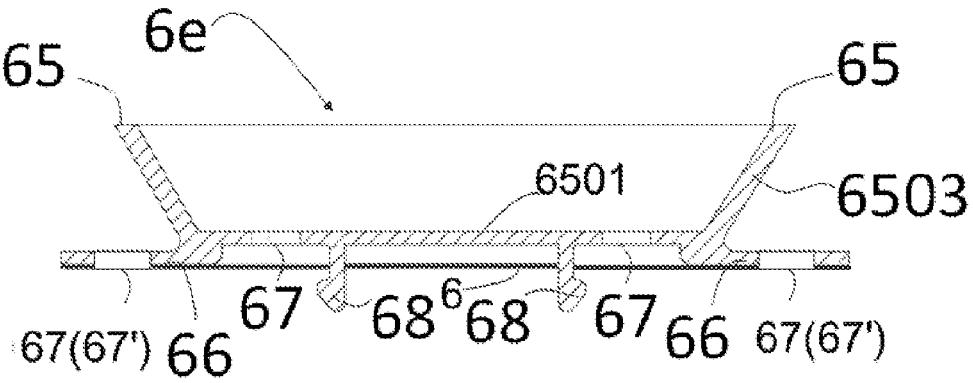
FIG. 11 illustrates a longitudinal sectional view of the electrical isolation assembly along the central axis according to yet another embodiment.

Referring to FIGS. 10-11, an LED bulb lamp deploying the arrangement with two sets of LED light sources as shown in FIG. 9 is described. FIG. 10 and FIG. 11 illustrate a longitudinal sectional view of the electrical isolation assembly along the central axis according to an embodiment of this invention, respectively.

Firstly referring to FIG. 10, in this embodiment, except the electrical isolation assembly 6*d* and the LED light sources 51 on the LED lamp substrate 5 have a different arrangement with the arrangements of the electrical isolation assemblies 6*a*, 6*b*, 6*c*, and the light sources 51 described in the above embodiments, the other assemblies and their connection relationship can be the same with those in above embodiments and need not be repeated here.

In this embodiment, the electrical isolation assembly 6*d* comprises light processing unit 64, its main body 6403 is non-straight camber surface, and its bottom portion 6401 is formed with the through holes 67 corresponding to the LED light sources 511 on the light substrate 5. It should be noted that the electrical isolation unit 6 also is formed with corresponding through holes 67'. Further, it should be understood that the main body 6403 may be other shape although a shape of camber surface is discussed here.

In one embodiment, just an outside surface of the main body 6403 is formed with a reflecting surface. In this case, when the electrical isolation assembly 6*d* is disposed on the LED lamp substrate 5 as shown in FIG. 9, the first set of LED light sources 51 are arranged inside the main body 6403 in an encircling manner, and the light emitted by the first set of light sources 511 can cross through the through holes 67' and the through holes 67 formed on the electrical isolation unit 6 and the bottom portion 6403 correspondingly and are outputted to the lamp housing 7 directly. In addition, the second set of light sources 51 are under the light processing assembly 64 so that one part of each LED light source in this set are exposed outside main body 6403 of the light processing assembly 64 and one part are located under the main body 6403. Then the light emitted by the part of each LED light sources 51 exposed outside the main body 6403 of the light processing unit 64 is reflected by the reflecting surface towards outside of the main body 6403; the light emitted by the part of each LED light sources located under the main body 6403 goes toward outside along the camber surface of the main body 6403 from the bottom up.

It should be understood that both the inside and outside surface of the main body 6403 can be formed with a reflecting surface. In such case, as above, for the first set of light sources 51 located under the light processing unit 64, the light emitted by the part of each of the light sources 51 exposed outside the main body 6403 of the light processing unit 64 is reflected by the reflecting surface on the outside surface of the main body 6403 towards outside of the main body 6403, and the light emitted by the part of the light sources 51 located under the main body 6403 of the light processing unit 64 goes toward outside along the camber surface of the main body 6403 from the bottom up. Meanwhile, for the LED light sources 511 arranged inside the main body 6403 in an encircling manner, the light emitted by each of the light sources 511 is reflected by the reflecting surface on the inside surface of the main body 6403 towards inside of the main body 6403. This arrangement can bring another illumination effect.

In addition, it is possible that only an inside surface of the main body 6403 can be formed with a reflecting surface. In this case, for the LED light sources 511 arranged inside the main body 6403 in an encircling manner, the light emitted by each of the light sources 511 emit to the lamp housing directly. Meanwhile, for the light sources 51 located under the light processing unit 64, the light emitted by each of the light sources 511 goes toward outside from the bottom up along the camber surface of the main body 6403. This arrangement can bring yet another illumination effect.

Figure 12:
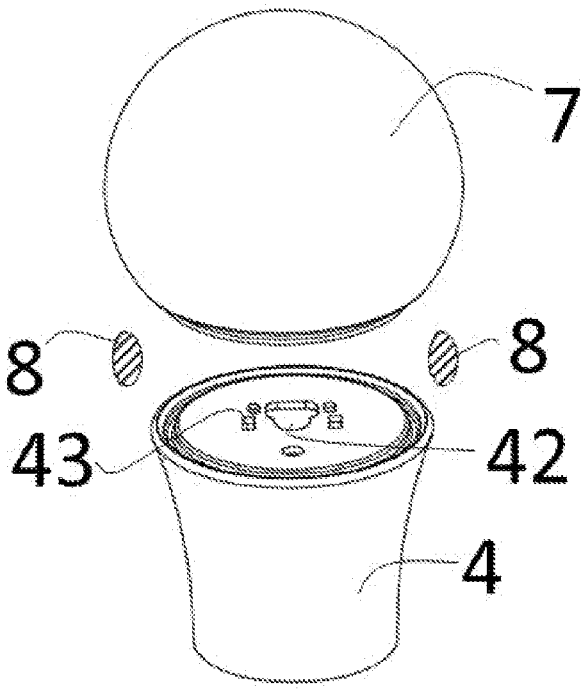
FIG. 12 illustrates a schematic view of an adhesive film coating between the lamp housing and the radiator according to an embodiment.

Referring to FIG. 12, another embodiment of the LED bulb lamp deploying the arrangement with two sets of LED light sources as shown in FIG. 9 is described.

The electrical isolation assembly 6*e* comprises light processing unit 65, the side surface's side boundary of its main body 6503 is straight line, and its bottom portion 6503 is formed with the through holes 67 corresponding to the LED light sources 511 on the LED lamp substrate 5. In addition, the electrical isolation assembly 6*e* further comprises extending portion 66 which is formed with the through holes 67 corresponding to the LED light sources 51 on the LED lamp substrate 5. The LED light sources 51, 511 can be arranged inside and outside the main body 6403 of the light processing unit 64 in an encircling manner at the same time. It should be noted that the electrical isolation unit 6 also is formed with corresponding through holes 67', and these through holes 67' are also corresponding to those disposed on the extending portion 66 and on the bottom portion 6501. Further, it should be understood that the main body 6503 may be other shape although it is discussed here with straight boundary line of its side surface.

In an embodiment, a reflecting surface is just formed on an outside surface of the main body 6503. In this case, when the electrical isolation assembly 6*e* is disposed on the LED lamp substrate 5 as shown in FIG. 10, the first set of LED light sources 51 are arranged inside the main body 6503 in an encircling manner, and the light emitted by the first set of light sources 511 can cross through the through holes 67' and the through holes 67 formed on the electrical isolation unit 6 and the bottom portion 6503 correspondingly and are outputted to the lamp housing 7 directly. In addition, the second set of light sources 51 are arranged outside the main body 6503 in an encircling manner, and the light emitted by the light sources 51 is reflected by the reflecting surface on the outside surface of the main body 6503 towards outside of the main body 6503.

It should be understood that both inside and outside surface of the main body 6503 can be formed with a reflecting surface. In such case, for the LED light sources 511 arranged inside the main body 6503 in an encircling manner, the light emitted by each of the light sources 511 is reflected by the reflecting surface on the inside surface of the main body 6503 towards inside of the main body 6503. Meanwhile, for the light sources 51 arranged outside the main body 6503 in an encircling manner, the light emitted by the light sources 51 is reflected by the reflecting surface on the inside surface towards outside of the main body 6503. This arrangement can bring another illumination effect.

In addition, it is possible that only an inside surface of the main body 6503 can be formed with a reflecting surface. In this case, for the LED light sources 511 arranged inside surface the main body 6503 in an encircling manner, the light emitted by the light sources 511 is reflected by the reflecting surface on the inside surface of the main body 6503 towards inside of the main body 6503. Meanwhile, for the light sources 51 arranged outside the main body 6503 in an encircling manner, the light emitted by the light sources 51 goes towards outside from the bottom up along the straight side surface of the main body 6503. This arrangement can bring yet another illumination effect.

In the above arrangements, the emitting direction of the light outside the main body 6503 can be adjusted by changing the design of the angle of the inside or outside surface of the main body 6503 with the extending surface of the bottom portion 6501.

It should be noted that the electrical isolation assembly 6*d*, 6*e* in the above embodiments can be the same as the electrical isolation assembly 6*b* with the fixing elements 68 arranged under the bottom portion 6401, 6501 of the light processing unit 64, 65 to connect the electrical isolation assembly 6*d*, 6*e* with the LED lamp substrate 5 and the radiator 4. Similarly, in the case of the electrical isolation assembly 6*a* includes only the electrical isolation unit 6 (i.e. it does not include the light processing unit 64, 65), the fixing elements 68 can be disposed on the electrical isolation unit 6. The fixing elements 68 can employ the lock structure to achieve the lock connection.

When the electrical isolation assembly 6*d*, 6*e* is disposed on the LED lamp substrate 5 by the fixing elements 68, the through holes 67 on the bottom portion 6403 and the through holes 67 on the extending portion 66 can be embedded with the two sets of light sources 51 on the LED lamp substrate 5 correspondingly. As the above embodiment, the electrical isolation unit 6, the extending portion 66 and the fixing element 68 can employ an electrical insulation design. Thus, the whole electrical isolation assembly 6*d*, 6*e* can cover the charged part on the LED lamp substrate 5 such that the charged part would not expose to the outside even though the lamp housing 7 is broken, so users can be protected from contacting the charged part to avoid an electric shock accident.

In addition, it should be understood that the electrical isolation unit 6, the light processing unit 61/62/63/64/65, the extending portion 66 and the fixing elements 68 can be integrally formed. They can be made of PC plastic materials having the reflectivity more than 92% or metal materials with high reflectivity by plating processing.

FIG. 12 illustrates a schematic figure of adhesive film coating between the lamp housing and the radiator according to an embodiment. In the above described embodiments, a layer of adhesive film can be coated on the inside or outside surface of the lamp housing 7 or between the lamp housing 7 and the radiator 4 to isolate the outside of the lamp housing 7 from the inside when the lamp housing is broken.

The main ingredient of the adhesive film 8 is calcium carbonate or strontium orthophosphate that can collocate with organic solvents to blend appropriately. In one embodiment, the adhesive film 8 consists of vinyl-terminated silicon oil, hydrosilicon oil, dimethylbenzene and calcium carbonate.

Dimethylbenzene is a supporting material among these ingredients, which volatilizes when the adhesive film has been coated on the inside or outside surface of the lamp housing 7 and has been solidified, and the main function of dimethylbenzene is to adjust viscosity so as to adjust the thickness of the adhesive film.

The thickness selection of the adhesive film 8 is related to the total weight of the LET bulb lamp. The thickness of the adhesive film 8 could be between 200 μm~300 μm when the radiator 4 is injected by heat conducting glue (casting glue) (consisting of at least 70% of the heat conducting glue which is 0.7~0.9 W/m*K) and the total weight of the LED bulb lamp is more than 100 g.

The total weight of the LED bulb lamp is less than about 80 g when there is no heat conducting glue being injected into the radiator 4, and the thickness of the adhesive film 8 can be 40 μm~90 μm so that the LED bulb lamp could have the ability of anti-explosion. The lower limit of the thickness is related to the total weight of the LED bulb light but the question of anti-explosion should be considered, whereas the light transmittance will not be enough and the cost of materials will be increased if the upper limit is more than 300 μm.

When the lamp housing 7 is broken, the adhesive film 8 will join the fragments of the lamp housing 7 together to avoid forming a hole throughout the inside and the outside of the lamp housing 7, so that protecting user from contacting the charged part inside the lamp housing 7 to avoid electric shock accidents.

In addition, the LED bulb lamp according to the disclosure can be selectively coated with a layer of diffusion film on the inside or the outside surface of the lamp housing 7 to mitigate the granular sensation of user watching the light sources 51. Further, the diffusion film not only has the function of diffusing light but also has the function of electrical isolation so as to reduce the risk of electric shock when the lamp housing 7 is broken. In addition, the diffusion film can enable the light to be diffusing to all direction when the LED light sources is lighting, and avoiding generating a dark area on the top of the lamp housing 7 to make a more comfortable lighting environment.

The main ingredients of the diffusion film can comprise at least one or combination of calcium carbonate, calcium halophosphate and aluminum oxide. The diffusion film could have optimal effect of light diffusion and transmission (more than 90% in some cases) when formed by calcium carbonate with an appropriate solution. In an embodiment, the ingredients of the diffusion film comprise: calcium carbonate (e.g., CMS-5000, white powder), thickener (e.g., thickener DV-961, milky white liquid), and ceramic activated carbon (e.g., ceramic activated carbon SW-C, colorless liquid). The chemical name of the thickener DV-961 is colloidal silica modified acrylic resin which is used to increase the stickiness when the calcium carbonate is coated on the inside or outside surface of the lamp housing 7 and comprises the ingredients of acrylic resin, silicone gel and pure water.

In one embodiment, the diffusion film adopts calcium carbonate as the main ingredient and collocates with thickener, ceramic activated carbon and deionizer water. These ingredients are coated on the inside or outside surface of the lamp housing 7 after blending, and the average coat thickness is in the range of 20 μm~30 μm. The deionizer water will volatilize at last and only the three ingredients of calcium carbonate, thickener, and ceramic activated carbon left. In an embodiment, if the diffusion film is formed with different ingredients, the thickness range of the diffusion film can be adopted is 200 μm~300 μm and the light transmittance is kept in the range of 92%~94%, which will have a different effect.

In other embodiments, calcium halophosphate and aluminum oxide can be selected as the main ingredients of the diffusion film. The particle size of calcium carbonate is in the range of about 2 μm~4 μm, whereas the particle sizes of calcium halophosphate and aluminum oxide are in the ranges of about 4 μm~6 μm and 1 μm~2 μm respectively. When the required range of light transmittance is 85%~92%, the average thickness of the diffusion film which has the main gradient of calcium carbonate in whole is about 20 μm~30 μm; the average thickness of the diffusion film which has the main gradient of calcium halophosphate is 25 μm~35 μm and the average thickness of the diffusion film which has the main gradient of aluminum oxide is 10 μm~15 μm when requiring the same light transmittance. If requiring a higher light transmittance, for example, more than 92%, the required thickness of the diffusion film which has the main ingredient of calcium carbonate, calcium halophosphate and aluminum oxide should be thinner. For example, the required thickness of the diffusion film which has the main ingredient of calcium carbonate should be within 10 μm~15 μm. That is, the main ingredients and the corresponding formed thickness, or the like, of the diffusion film to be coated can be selected based on the usage occasion of the LET bulb lamp which has different requirement of light transmittance.

In addition, the LED bulb lamp of present disclosure can be selectively coated with a thin layer of reflecting film on the inside top surface of the lamp housing 7 to convert a portion of the light outputting towards the top of the lamp housing 7 by LED light sources 51 to the sidewall. The reflecting film may have the main gradient of barium sulfate and may be mixed with thickener, 3% of ceramic activated carbon and deionizer water. In an embodiment, the concentration of barium sulfate can be in the range of 45%-55%, and the thickness of the formed reflecting film 9 is about 20 μm~30 μm at this moment. When the average thickness of the coated reflecting film 9 is about 17 μm~20 μm, the light transmittance is up to about 97~98%, that is, 2% of the light emitting towards topside could be reflected towards the sidewall of the LED bulb lamp.

Figure 13:
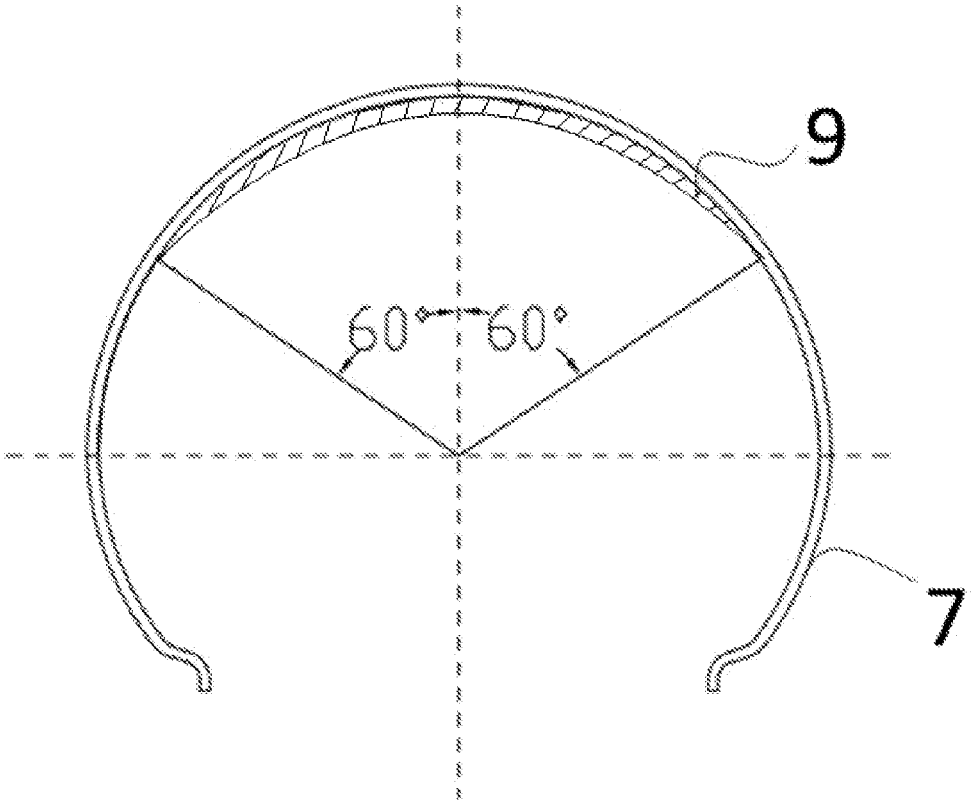
FIG. 13 illustrates a longitudinal sectional view of the lamp housing coated with the reflecting film along the central axis according to an embodiment.

It's to be noted that the target of coating reflecting film 9 is to generate reflection effect after the light hitting the barium sulfate particles, thus there is no need to coat the total lamp housing 7 with the reflecting film 9. As shown in FIG. 13, taking the central axis which is from the lamp head 1 to the center of the lamp housing 7 as the center, the reflecting film 9 can be coated on an approximate equal area from the central axis, that is, the coated reflecting film is distributed symmetrically along the central axis as a circular curved surface, and the coated t reflecting film within an area which has a certain angle with the central axis. In an embodiment, the angle can be 0degree~60 degree. Preferably, the angle can be 0 degree~45 degree. In addition, when the concentration of the selected reflecting film solution is higher, the coated reflecting film 9 need not to be too thick. Of course, if the requirement for the light transmittance is just 95%, that is, 5% of the light emitting upward will be reflected towards the sidewall of the LED bulb lamp, an adoptable concentration of the barium sulfate solution can be about 55%~60%, and the layer thickness of the reflecting film can be in the range of 25 μm~30 μm. Further, due to on the top of the lamp housing, the light luminance of the light distributed within the area where the angle with the central axis is 0 degree~60 degree is diminishing from 0 degree to 60 degree, so the layer thickness of the reflecting film can be gradually reduced from 0 degree at which the thickness is biggest to 60 degree at which the thickness is smallest.

It should be understood that the above described embodiments are merely preferred embodiments of the invention, but not intended to limit the invention. Any modifications, equivalent alternations and improvements, or any direct and indirect applications in other related technical field that are made within the spirit and scope of the invention described in the specification and the figures should be included in the protection scope of the invention.

What is claimed is:

1. An LED bulb lamp, comprising:

a base;

a power supply installed in the base and having an output wire, the output wire having an end;

a lamp housing disposed on the base;

an LED lamp substrate disposed on the base, the LED lamp substrate having a plurality of powered parts and a plurality of LED light sources mounted on a top surface of the LED lamp substrate, the LED lamp substrate further having a first via hole, the output wire of the power supply electrically connecting with the LED lamp substrate through the first via hole, the powered parts further comprising the end of the output wire; and an electrical isolation assembly disposed on the LED lamp substrate electrically isolating the powered parts on the top surface of the LED lamp substrate from outside of the electrical isolation assembly when the powered parts are powered, and installed inside the lamp housing, the electrical isolation assembly comprising an electrical isolation unit covering the top surface of the LED lamp substrate, and including a light processing unit having a main body, wherein a cavity is formed inside the main body by arranging the main body in an encircling manner around a central axis, and the main body has a light receiving surface including a bottom surface parallel to the top surface of the LED lamp substrate and overlapping the LED light sources from a top-down view, to be facing the LED light sources to receive light from the LED light sources, wherein the cavity is formed inside a circular shape formed by said bottom surface and allows light to pass therethrough, and the cavity extends along the central axis from at least a height of a top surface of the LED light sources toward the lamp housing above the LED light sources;

wherein the electrical isolation assembly is an integrally formed unit, and wherein bottom surfaces of the LED light sources are at a first vertical level, at least a portion of the electrical isolation assembly is at the first vertical level, and wherein the cavity is open at its top to provide an open path between the LED light sources and a top of the lamp housing disposed above the cavity.

2. The LED bulb lamp of claim 1, wherein a side surface of the main body forms a surface of the cavity, and wherein each LED light source of the LED light sources is both directly below said bottom surface of the light receiving surface from a top-down view and is exposed to the cavity.

3. The LED bulb lamp of claim 2, wherein the cavity is open toward the lamp housing above the LED light sources, a portion of light from each LED light source of the LED light sources enters the main body through said bottom surface of the light receiving surface and another portion of light from each LED light source of the LED light sources enters the cavity directly, without passing through the main body.

4. The LED bulb lamp of claim 3, wherein the LED light sources on the LED lamp substrate are arranged under said bottom surface of the light receiving surface of the main body in an encircling manner.

5. The LED bulb lamp of claim 4, wherein the electrical isolation assembly further comprises a fixing element disposed on the bottom portion of the electrical isolation assembly and integrally formed with the electrical isolation assembly, and the electrical isolation assembly is fixed inside the lamp housing by the fixing element.

6. The LED bulb lamp of claim 5, wherein the fixing element is disposed on the electrical isolation unit.

7. The LED bulb lamp of claim 3, the LED lamp substrate including two sets of LED light sources, wherein the first set of LED light sources are arranged under said bottom surface of the light receiving surface of the main body in an encircling manner around the central axis, the second set of LED light sources are arranged within the cavity.

8. The LED bulb lamp of claim 3, wherein the powered parts electrically connect the LED lamp substrate to the power supply.

9. The LED bulb lamp of claim 1, wherein the electrical isolation unit and the light processing unit are integrally formed.

10. An LED bulb lamp, comprising:

a base;

a power supply installed in the base and having an output wire, the output wire having an end;

a lamp housing disposed on the base;

an LED lamp substrate disposed on the base, the LED lamp substrate having a plurality of powered parts and having a plurality of LED light sources mounted on a top surface of the LED lamp substrate; and an electrical isolation assembly disposed on the LED lamp substrate electrically isolating the powered parts on the top surface of the LED lamp substrate from outside of the electrical isolation assembly when the powered parts are powered, and installed inside the lamp housing, the electrical isolation assembly comprising an electrical isolation unit covering and extending to at least an outer edge of the top surface of the LED lamp substrate and a light processing unit having a main body, wherein a cavity is formed in a space within the main body by arranging the main body to form outer sides of the cavity, and the main body has a light receiving surface parallel to the top surface of the LED lamp substrate and facing and vertically overlapping the LED light sources to receive light from the LED light sources, wherein the cavity is open at its top to provide an open path between the LED light sources and a top of the lamp housing disposed above the cavity, wherein the electrical isolation assembly is an integrally formed unit, and wherein a bottom surface of the electrical isolation assembly covers a top surface of the LED lamp substrate.

11. The LED bulb lamp of claim 10, wherein a side surface of the main body forms the outer surface of the cavity and a bottom surface of the main body forms the light receiving surface.

12. The LED bulb lamp of claim 11, wherein a mouth of the cavity is formed adjacent to the LED light sources, a portion of light from the LED light sources enters the main body through the light receiving surface and another portion of light from the LED light sources enters the cavity through the mouth.

13. The LED bulb lamp of claim 10, wherein the LED light sources on the LED lamp substrate are arranged under the light receiving surface of the main body in an encircling manner.

14. The LED bulb lamp of claim 10, wherein the electrical isolation assembly further comprises a fixing element disposed on the bottom portion of the electrical isolation assembly and integrally formed with the electrical isolation assembly, and the electrical isolation assembly is fixed inside the lamp housing by the fixing element.

15. The LED bulb lamp of claim 10, wherein:

the light receiving surface facing the LED light sources directly contacts the LED light sources.

16. The LED bulb lamp of claim 10, wherein:

a portion of light from the LED light sources reaches the lamp housing by entering the main body of the electrical isolation assembly at the light receiving surface, and a portion of light from the LED light sources reaches the cavity directly.

17. The LED bulb lamp of claim 16, wherein:

the cavity includes a space above a center of the LED lamp substrate.

18. The LED bulb lamp of claim 10, wherein:

the top surface of the LED lamp substrate is electrically isolated from outside of the LED lamp substrate by being fully covered, without any gaps exposed to the lamp housing, by the electrical isolation assembly.

19. An LED bulb lamp, comprising:

a base;

a power supply installed in the base and having an output wire, the output wire having an end;

a lamp housing disposed on the base;

an LED lamp substrate disposed on the base, the LED lamp substrate having a plurality of powered parts and a plurality of LED light sources mounted on a top surface of the LED lamp substrate, wherein the output wire of the power supply electrically connects with the powered parts of the LED lamp substrate; and an electrical isolation assembly disposed on the LED lamp substrate and installed inside the lamp housing, the electrical isolation assembly comprising an electrical isolation unit covering the LED lamp substrate, and including a light processing unit having a main body disposed on the LED light sources, and a fixing element disposed on the electrical isolation unit to fix the electrical isolation assembly inside the lamp housing such that the top surface of the LED lamp substrate is electrically isolated from outside of the LED lamp substrate by being fully covered, by the electrical isolation assembly when the powered parts are powered, wherein the main body has a light receiving surface disposed above and overlapping the LED light sources from a top-down view, and parallel to a top surface of the LED lamp substrate to be facing the LED light sources, and a portion of light from LED light sources enters the main body through the light receiving surface, wherein the electrical isolation assembly is an integrally formed unit, and wherein a cavity is formed within the main body by arranging the main body in an encircling manner around a central axis, the cavity extending, in a direction along the central axis, from a height at a top of the LED light sources toward the lamp housing above the LED light sources and wherein the cavity is open at its top to provide an open path between the LED light sources and a top of the lamp housing disposed above the cavity.

20. The LED bulb lamp of claim 19, wherein a cavity is formed to be surrounded by the main body by arranging the main body in a symmetrical encircling manner around the central axis.

21. The LED bulb lamp of claim 20, wherein a side surface of the main body forms a surface of the cavity and a bottom surface of the main body forms the light receiving surface.

22. The LED bulb lamp of claim 19, wherein a portion of light from the LED light sources reaches the lamp housing by entering the main body of the electrical isolation assembly at the light receiving surface, and wherein a portion of light from the LED light sources reaches the lamp housing by passing through the cavity without entering the main body of the electrical isolation assembly.

23. An LED bulb lamp, comprising:

a base;

a power supply installed in the base and having an output wire, the output wire having an end;

a lamp housing disposed on the base;

an LED lamp substrate disposed on the base, the LED lamp substrate having a plurality of powered parts and a plurality of LED light sources mounted on a top surface of the LED lamp substrate, wherein the output wire of the power supply electrically connects with the powered parts of the LED lamp substrate; and an electrical isolation assembly disposed on the LED lamp substrate and installed inside the lamp housing, the electrical isolation assembly comprising an electrical isolation unit covering the LED lamp substrate, a light processing unit having a main body disposed on the LED light sources, and a fixing element disposed on the electrical isolation unit to fix the electrical isolation assembly inside the lamp housing such that the top surface of the LED lamp substrate is electrically isolated from outside of the LED lamp substrate by being fully covered, without any gaps exposed to the lamp housing, by the electrical isolation assembly when the powered parts are powered, wherein the main body has a light receiving surface facing the LED light sources, and a portion of light from LED light sources enters the main body through the light receiving surface, wherein the electrical isolation assembly is an integrally formed unit, wherein a cavity is formed to be surrounded by the main body by arranging the main body in an encircling manner, wherein a side surface of the main body forms a surface of the cavity and a bottom surface of the main body forms the light receiving surface, and wherein a mouth of the cavity is formed adjacent to the LED light sources, and another portion of light from the LED light sources enters the cavity through the mouth, and wherein the cavity is open at its top to provide an open path between the LED light sources and a top of the lamp housing disposed above the cavity.

* * * * *